United States Patent [19]

Baumann

[11] 4,078,644

[45] Mar. 14, 1978

[54] COIN FEED DEVICE FOR VENDING MACHINES

[76] Inventor: Viktor Baumann, 40 Cunliffe St., Johnsonville, Wellington, New Zealand

[21] Appl. No.: 729,487

[22] Filed: Oct. 4, 1976

[51] Int. Cl.[2] ..... G07F 5/04

[52] U.S. Cl. ..... 194/54

[58] Field of Search ..... 194/1 K, 1 G, 54, 71

[56] References Cited

U.S. PATENT DOCUMENTS 2,925,898 2/1960 Terry ..... 194/54

*Primary Examiner*—Stanley H. Tollberg

[57] ABSTRACT

A coin feed device for the release mechanism of a vending machine. The release mechanism includes a latch with a cam and the latch is released by a coin engaging the cam. The feed device comprises a tube of thin rectangular cross section and has a coin inlet at one end and an outlet at the other end. The outlet end has an extended cross-section projecting from one wall and a movable element engages the wall and extends into the extended cross-section to allow the size of the outlet to be selectively adjusted.

6 Claims, 4 Drawing Figures

IMPROVED COIN FEED DEVICE FOR VENDING MACHINES

BACKGROUND OF THE INVENTION

This invention relates to vending machines and more particularly to vending machines for newspapers, though the invention is not solely restricted to machines for the selling of newspapers.

To overcome the increased cost of employing labour to sell newspapers the use of honesty boxes or vending machines has become widespread.

Unfortunately, honesty boxes have led to monetary losses for the vendor as certain members of the public tend to take the newspaper without paying or only paying part of the total cost. The vending machine has provided a cheap and effective method of selling newspapers which goes some way to prevention of the newspapers being taken without payment.

One type of vending machine has been reasonably successful and this consists of a newspaper support rack covered by a transparent cover. The cover is locked by a mechanism which releases on insertion of the required coinage into slots provided. On release the cover is hinged away and a paper can be removed. The locking mechanism automatically latches on closing of the cover preparatory for the insertion of further coins.

Whilst the machine in question has been reasonably successful a problem has arisen with the feeding of coins to and their positioning in the release mechanism which leads to the mechanism jamming. Thus the buying public tend to shy away from the vending machine and purchase the newspapers from other sources. In addition the vending machine is not readily or easily adaptable to the different costs of papers being placed in the machine. For example the daily newspapers cost say 10¢ whereas the weekend papers cost in the vicinity of 25¢ and cannot be sold through the vending machine. As the price differential between daily and weekend papers is high the losses incurred with the weekend papers often makes them an uneconomical proposition. Thus a vending machine which is readily adapted to be operable with different coins is a great advantage.

Accordingly the present invention aims to provide a vending machine which can be readily altered to accept various combinations of different denominations of coins and is not prone to jamming when fed with incorrect coins.

SUMMARY OF THE INVENTION

In broad terms the invention in one aspect consists of a coin feed device for the release mechanism of a vending machine where the release mechanism includes a latch arm with associated cam means, the latch arm being released by a coin engaging the cam means said feed device comprising a tube of thin rectangular cross-section, provision at one end of said tube for a reception of a coin, an outlet at the other end of the tube, said other end having its cross-section extended to project outwardly from one side wall of the tube and a movable element engaged on the side wall of the tube from which the extended cross-section projects and extends into said extended cross-section to allow for selective adjustment of the distance between the outlet and the said side wall as extended by the movable element.

In a second aspect the invention consists of a vending machine having a coin operated release mechanism which includes a latch arm and a cam means on said latch arm, a feed device as described in the foregoing first aspect, the outlet of the feed tube being located substantially in line with the cam means, the end of the movable element within the extended portion being adjusted to terminate a distance away from the latch arm substantially equal to the diameter of a predetermined coin denomination whereby the coin is positioned so that movement of means to open the vending machine causes the cam means to engage the coin and release the latch arm to allow the vending machine to be opened.

DETAILED DESCRIPTION OF PREFERRED EMBODIMENT

Figure 1:
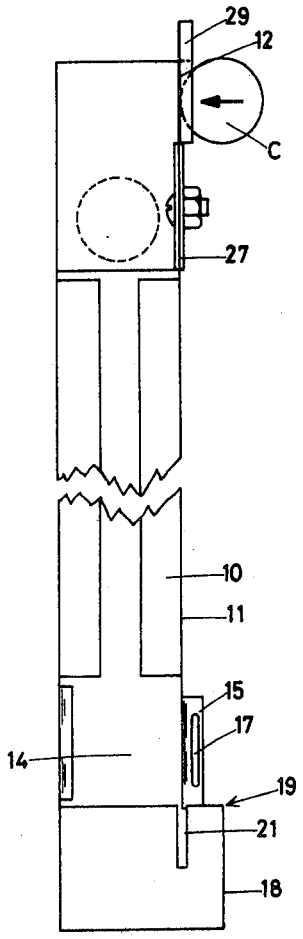
FIG. 1 is a side view of the feed tube.

The feed device is fabricated from a blank of sheet metal bent to form an elongate flat tube 10 of thin rectangular cross-section. The cross-section should be such that a coin of the largest denomination can pass through the tube. A portion of one side wall 11 of the tube 10 (hereinafter described as the "thin side wall") is removed at one end (hereinfter referred to as the "upper end") of the tube. This open portion provides the inlet 12 to the tube for a coin *c*. The upper end of the tube 10 can remain open or be closed, though the working of the device is no way altered by either arrangement. Near this upper end a mounting lug or bracket is provided and has provision for the reception of a fastening device.

Adjacent to the other or lower end of the tube 10 one wide side of the tube is removed as at 14 to provide an opening. Preferably a portion 15 of the removed portion is bent to project at an angle from the thin wall 11 to provide a mounting for the movable or slide element. An elongate slot 17 is cut in this mounting portion 15.

The lower section of the tube 10 below the aforesaid opening 14 forms the outlet 18 of the tube. This section is of the same cross-sectional thickness as the main length of the tube 10, however, it is increased in width so that it stands proud at 19 of the line of the thin wall 11. The slide element consists of a thin metal length 22 having a projection 23 bent at an angle, said projection 23 being slidably retained to the slotted projection 15 on the tube 10 by a bolt and wingnut arrangement 20. The main length of the slide engages with the outer surface of the thin wall and its lower end engages in slots 21 cut in the lower extended section 19 of the tube 10. Accordingly by use of the wingnut adjustment 20 the amount of projection of the slide 22 into the extended section 19 can be regulated. To assist in the smooth operation of the slide guide lugs 24 can be provided with the slide to engage and slide on either or both the wide face of the tube 10 and the extended section 19.

The feed device can be used in any type of vending machine having a cover or lid which is controlled by a release mechanism. The actual construction of the release mechanism can vary, however, it should include a release arm 25 having a cam means 26. The release arm is operated by a coin *c* engaging the cam means to permit the cover or lid locking means to unlatch and allow the cover or lid to be swung freely away to gain access to the newspapers in the machine.

Figure 2:
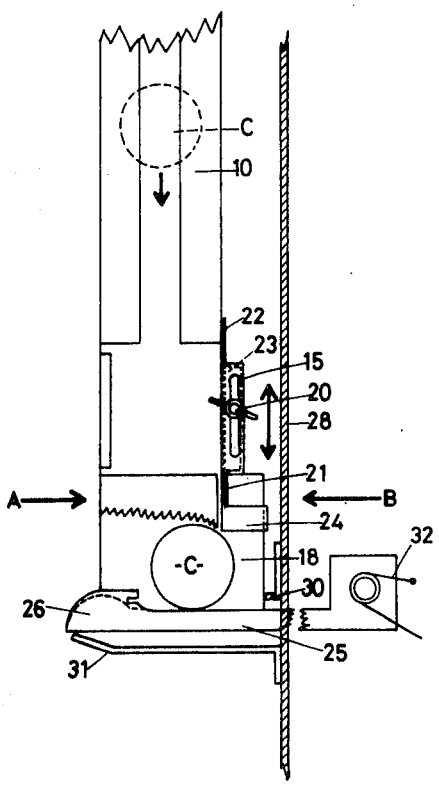
FIG. 2 is a side view of the lower end of the feed tube in conjunction with the release mechanism.
Figure 3:
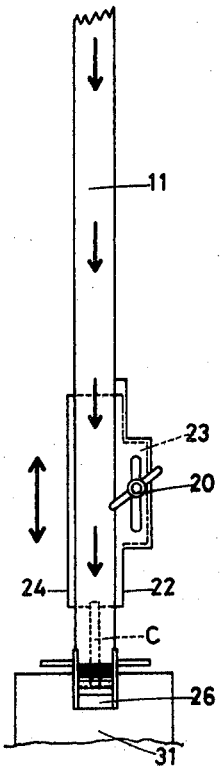
FIG. 3 is an edge view taken in the direction of arrow A of FIG. 2.
Figure 4:
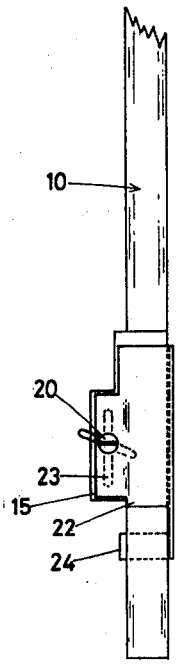
FIG. 4 is an edge view of the feed tube when viewed in the direction of arrow B of FIG. 2.

By way of example the cover or lid is provided with a first lever which has a projection which latches with a slot in a second lever when said cover or lid is in the closed position. To this second lever is connected the latch arm which is pivotally mounted at one end and is biassed by a coil spring 32 or the like. The latch arm 25 includes a latch portion which under the spring bias 32 normally engages a stop member 30. The feed tube 10 is mounted by the mounting lug, 27, and any other fixing means required, to the body 28 of the vending machine with the outlet 18 positioned above the cam means 26. The slide is positioned so that the distance from its lower end and the latch arm 25 is substantially equal to the diameter of a coin *c* (see FIG. 2). An externally mounted slotted access plate 29 is positioned adjacent the inlet 12 of the tube 10 to limit the size of coin *c* which can be inserted in the tube.

In use a coin is inserted and it falls down the tube to finish beneath the slide and resting on the latch arm 25. The cover or lid is then pulled to open and the cam means 26 rides on the coin *c* and so depresses the latch arm 25 sufficiently to allow the latch to clear the stop 30. Obviously, if the incorrect coin (i.e. too small) is inserted the latch arm 25 does not move down sufficiently to clear the stop 30 and the cover or lid cannot operate. If a coin is too large in diameter it cannot move under the slide and accordingly when the cover or lid is pulled to open the cam means 26 will clear the coin which will fall into a collection container 31 but the latch arm 25 will still not clear the stop 30. This latter situation will only occur when the incorrect access plate 29 has been inserted.

To permit the machine to operate for multiple coin amounts e.g. 10¢ or 25¢ papers two or more mechanisms are positioned side by side with the necessary access plates 29 positioned over the respective inlet slots. It will be realised that to alter the feed mechanism for a different denomination of coin is a simple matter as the wingnut 20 is loosened and the slide moved up or down to obtain the correct distance from the latch arm 25. Thus the machine can quickly be changed from daily to weekend paper charges with the adjustment and placing of the suitable access plate 29. As the tube 10 is designed to take the largest denomination of coin jamming cannot occur, as with previous designs.

What is claimed is:

1. A coin feed device for the release mechanism of a vending machine wherein the release mechanism includes a latch arm with associated cam means, the latch arm being released by a coin engaging the cam means, said feed device comprising:

a tube of thin rectangular cross-section having a width slightly greater than the thickness of the largest denomination coin to be fed through said tube;

provision at one end of said tube to form an inlet for reception of a coin, the other end of the tube being open to form an outlet from the tube, said other end having its cross-section extended to project outwardly from one side wall of the tube; and a movable element engaged with said one side wall, said extended cross-section having a pair of opposed parallel slots provided in the side walls thereof, said slots being aligned with said one side wall, a portion of said movable element being located in said slots and projecting into said extended cross-section as an extension of said one side wall for selective adjustment of the distance between the outlet and the said one side wall by movement of said movable element.

2. A coin feed device as claimed in claim 1 wherein the movable element includes a length which engages against the thin wall of the tube aligned with the said slots said length having a lug which is slidingly mounted on an extension from the tube.

3. A coin feed device as claimed in claim 2 wherein the extension includes an elongate slot and said lug is attached to said extension by a bolt and wingnut engaged through said elongate slot.

4. A coin feed device as claimed in claim 3 wherein the length of said movable element is provided with guides engaging with one or more of the walls of said tube.

5. A vending machine having a coin release mechanism which includes a latch arm and a cam means on said latch arm, a feed device as claimed in claim 4, the outlet of the feed tube being located substantially in line with the cam means, the end of the movable element within the extended portion being adjusted to terminate a distance away from the latch arm substantially equal to the diameter of a predetermined coin denomination whereby the coin is positioned so that movement of means to open the vending machine causes the cam means to engage the coin and release the latch arm to allow the vending machine to be opened.

6. A vending machine as claimed in claim 5 wherein a removable access plate is positioned adjacent the inlet of the tube the said plate having a slot which is of a dimension suitable for reception of a coin the required size to operate said release mechanism.

* * * * *